US012365957B2

(12) United States Patent
Arancon Alvarez et al.

(10) Patent No.: US 12,365,957 B2
(45) Date of Patent: Jul. 22, 2025

(54) METHOD FOR MANUFACTURING A RAIL AND CORRESPONDING RAIL

(71) Applicant: ArcelorMittal, Luxembourg (LU)

(72) Inventors: José Arancon Alvarez, Avilès (ES); David Alvarez Diez, Gozons (ES); José Manuel Artimez Encina, Avilès (ES); Francisca Garcia Caballero, Madrid (ES); Benjamin Pohu, Liege (BE)

(73) Assignee: ArcelorMittal, Luxembourg (LU)

( * ) Notice: Subject to any disclaimer, the term of this patent is extended or adjusted under 35 U.S.C. 154(b) by 250 days.

(21) Appl. No.: 16/767,105

(22) PCT Filed: Nov. 27, 2018

(86) PCT No.: PCT/IB2018/059349
§ 371 (c)(1),
(2) Date: May 26, 2020

(87) PCT Pub. No.: WO2019/102439
PCT Pub. Date: May 31, 2019

(65) Prior Publication Data

US 2020/0291498 A1 Sep. 17, 2020

(30) Foreign Application Priority Data

Nov. 27, 2017 (WO) ..... PCT/IB2017/057424

(51) Int. Cl.
*C21D 9/04* (2006.01)
*C21D 6/00* (2006.01)
(Continued)

(52) U.S. Cl.
CPC ..... *C21D 9/04* (2013.01); *C21D 6/002* (2013.01); *C21D 6/005* (2013.01); *C21D 6/008* (2013.01);
(Continued)

(58) Field of Classification Search
CPC ..... C21D 9/04; C21D 6/005; C21D 6/008; C21D 2211/001; C21D 2211/002;
(Continued)

(56) References Cited

U.S. PATENT DOCUMENTS 5,382,307 A 1/1995 Kageyama et al.
5,658,400 A * 8/1997 Uchino ..... C21D 8/00 148/333
(Continued)

FOREIGN PATENT DOCUMENTS

CN 101586216 B * 4/2011
CN 102220545 A 10/2011
(Continued)

OTHER PUBLICATIONS

Search Report of PCT/IB2018/059349.
(Continued)

*Primary Examiner* — Jonathan Johnson
*Assistant Examiner* — Maxwell Xavier Duffy
(74) *Attorney, Agent, or Firm* — Davidson Kappel LLC

(57) ABSTRACT

A method for manufacturing a rail includes casting a steel to obtain a semi-product. The steel has a composition comprising 0.20%≤C≤0.60%, 1.0%≤Si≤2.0%, 0.60%≤Mn≤1.60% and 0.5≤Cr≤2.2%, optionally 0.01%≤Mo≤0.3%, 0.01%≤V≤0.30%; the remainder being Fe and impurities. The method also includes hot rolling the semi-product into a hot rolled semi-product having the shape of the rail and comprising a head, with a final rolling temperature $T_{FRT}$ higher than Ar3; and cooling the head to a cooling stop temperature $T_{CS}$ between 200° C. and 520° C. The method also includes maintaining the head in a temperature range comprised between 300° C. and 520° C. during a holding time $t_{hold}$ of at least 12 minutes, and; cooling down the hot rolled semi-product to room temperature to obtain the rail.

19 Claims, 3 Drawing Sheets

(51) Int. Cl.

| | |
|---|---|
| ***C22C 38/00*** | (2006.01) |
| ***C22C 38/02*** | (2006.01) |
| ***C22C 38/04*** | (2006.01) |
| ***C22C 38/22*** | (2006.01) |

(52) U.S. Cl.
CPC ..... *C22C 38/001* (2013.01); *C22C 38/002* (2013.01); *C22C 38/02* (2013.01); *C22C 38/04* (2013.01); *C22C 38/22* (2013.01); *C21D 2211/001* (2013.01); *C21D 2211/002* (2013.01); *C21D 2211/008* (2013.01)

(58) Field of Classification Search
CPC ... C21D 2211/008; C22C 38/02; C22C 38/04; C22C 38/18; B21B 1/085
See application file for complete search history.

(56) References Cited

U.S. PATENT DOCUMENTS

| | | | | |
|---|---|---|---|---|
| 5,879,474 | A | 3/1999 | Bhadeshia et al. | |
| 6,086,685 | A | 7/2000 | Joller et al. | |
| 2011/0253268 | A1 | 10/2011 | Zou et al. | |
| 2012/0305144 | A1* | 12/2012 | Okamoto | C21D 6/00 148/333 |
| 2014/0130943 | A1 | 5/2014 | Bramfitt et al. | |
| 2014/0144557 | A1* | 5/2014 | Zhang | C21D 8/005 148/547 |
| 2015/0218759 | A1 | 8/2015 | Pointner et al. | |
| 2018/0010207 | A1* | 1/2018 | Futamura | C22C 38/005 |
| 2019/0003009 | A1* | 1/2019 | Kawata | C22C 38/04 |

FOREIGN PATENT DOCUMENTS

| | | | | | |
|---|---|---|---|---|---|
| EP | 0612852 | A1 | | 8/1994 | |
| EP | 1873262 | A1 | | 1/2008 | |
| EP | 3124636 | A1 | | 2/2017 | |
| JP | 2002363698 | A | | 12/2002 | |
| JP | 2005146321 | A | * | 6/2005 | |
| JP | 6085348 | B2 | * | 2/2017 | B32B 15/013 |
| JP | 2017053001 | A | * | 3/2017 | |
| RU | 2086671 | C1 | | 8/1997 | |
| RU | 2136767 | C1 | | 9/1999 | |
| WO | WO9622396 | A1 | | 7/1996 | |
| WO | WO-2017164346 | A1 | * | 9/2017 | B32B 15/013 |

OTHER PUBLICATIONS

Sawley K. and Kristan J.: 11 Development of bainitic rail steels with potential resistance to rolling contact fatigue, Fatigue Fract Engng Mater Struct, vol. 26, Oct. 17, 2003 (Oct. 17, 2003), pp. 1019-1029, XP002782176, DOI: 10.1046/j.1460-2695.2003.00671.x.

* cited by examiner

METHOD FOR MANUFACTURING A RAIL AND CORRESPONDING RAIL

The present invention concerns a method for producing a steel rail having excellent mechanical properties and wear and rolling contact fatigue resistances, as well as a corresponding steel rail.

SUMMARY

In recent years, train speed and load have been increased to improve railroad transportation and contact stresses can exceed 2000 MPa. These more severe service conditions require new rails with higher wear and rolling contact fatigue resistance, especially for heavy industrial railway traffic.

Wear and rolling contact fatigue (RCF) are two important factors that may cause a delayed failure in the railway track. Whereas the mechanisms for wear have been fully studied and are well understood, and wear is nowadays managed in the railway system, RCF is still not sufficiently understood to have efficient solutions to prevent the formation of RCF defects, which can cause progressive deterioration and a premature maintenance of the rail.

The traditional approach for the development of new rail steels to address wear and RCF has been to increase steel hardness and strength. In the case of conventional pearlitic grades for railways, this increase has been achieved during the last 40 years by decreasing the interlamellar spacing, by adding costly alloying elements or through head hardening. Nevertheless, this increase in resistance to wear is generally accompanied by a decrease in toughness. The aforementioned challenges are showing that despite all the research that has been taken place to develop new microstructures with enhanced mechanical properties, pearlitic steel grades have already reached their limits in terms of wear and rolling contact fatigue performance, which means that the existing railway grades cannot cope with the most demanding in-service conditions.

Bainitic steels, comprising for example lower bainite microstructure, have been considered as the next generation of advanced high strength steels and candidate materials for heavy-duty rails and railway-crossings due to a good combination of hardness, strength and toughness.

Bainitic steels comprising lower bainite microstructure provide good wear resistance but do not achieve a sufficient RCF resistance.

Especially, WO1996022396A1 discloses a method for producing a high strength wear and rolling contact fatigue resistant rail. The rail is produced from a steel having a composition comprising 0.05% to 0.5% C, 1.00% to 3.00% Si and/or Al, 0.50% to 2.50% Mn and 0.25% to 2.50% Cr. The rail is produced by air cooling the steel from the finish hot rolling temperature.

EP 1 873 262 discloses a method for manufacturing high-strength guide rails, from a steel comprising 0.3% to 0.4% C, 0.7% to 0.9% Si, 0.6% to 0.8% Mn and 2.2% to 3.0% Cr. The manufacturing method comprises air cooling the steel after formation of a bainitic structure. However, EP 1 873 262 does not teach any specific cooling rate.

EP 0 612 852, US2015218759 and US20150322553A1 disclose methods for producing bainitic rails by accelerated cooling. However, these rails do not show a sufficient Rolling Contact Fatigue resistance.

SUMMARY

Therefore, it remains desirable to produce steel rails.

An object of this present disclosure is to provide a method of manufacturing high performance rail having excellent rolling-contact fatigue resistance and wear resistance.

Especially, it is desirable to produce a steel rail wherein the rail head has a tensile strength of at least 1300 MPa, a yield strength of at least 1000 MPa, a total elongation of at least 13% and a hardness of at least 420 HB and preferably of at least 430 HB together with excellent rolling-contact fatigue resistance and wear resistance.

A method is provided for manufacturing a rail comprising a head, the method comprising the following successive steps:

- casting a steel so as to obtain a semi-product, said steel having a chemical composition comprising, by weight percent:
  - $0.20\% \leq C \leq 0.60\%$,
  - $1.0\% \leq Si \leq 2.0\%$,
  - $0.60\% \leq Mn \leq 1.60\%$,
  - and $0.5 \leq Cr \leq 2.2\%$,
  - and optionally one or more elements chosen among
  - $0.01\% \leq Mo \leq 0.3\%$,
  - $0.01\% \leq V \leq 0.30\%$;

the remainder being Fe and unavoidable impurities resulting from the smelting;

- hot rolling the semi-product into a hot rolled semi-product having the shape of the rail and comprising a head, with a final rolling temperature $T_{FRT}$ higher than Ar3;
- cooling the head of the hot rolled semi-product from the final rolling temperature $T_{FRT}$ down to a cooling stop temperature $T_{CS}$ comprised between 200° C. and 520° C., such that the temperature of the head of the hot rolled semi-product over time is comprised between a upper boundary and a lower boundary, the upper boundary having the coordinates of time and temperature defined by A1 (0 second, 780° C.), B1 (50 seconds, 600° C.), and C1 (110 seconds, 520° C.), the lower boundary having the coordinates of time and temperature defined by A2 (0 second, 675° C.), B2 (50 seconds, 510° C.), and C2 (110 seconds, 300° C.);
- maintaining the head of the hot rolled semi-product in a temperature range comprised between 300° C. and 520° C. during a holding time $t_{hold}$ of at least 12 minutes, and;
- cooling down the hot rolled semi-product to room temperature to obtain the rail.

The method for manufacturing a rail may further comprise one or more of the following features, taken along or according to any technically possible combination,

- the microstructure of the head of the rail consists of, in surface fraction:
  - 49% to 67% of bainite;
  - 14% to 25% of retained austenite, the retained austenite having an average carbon content comprised between 0.80% and 1.44%;
  - 13% to 34% of tempered martensite;
- the surface fraction of bainite in the microstructure of the head is higher than or equal to 56%;
- the surface fraction of retained austenite in the microstructure of the head is comprised between 18% and 23%;
- the surface fraction of tempered martensite in the microstructure of the head is comprised between 14.5% and 22.5%;
- the average carbon content in the retained austenite is higher than 1.3%;
- the cooling stop temperature $T_{CS}$ is comprised between 300° C. and 520° C.;

the cooling stop temperature $T_{CS}$ is comprised between 200° C. and 300° C., and the method further comprises, after the step of cooling the head of the hot rolled semi-product down to the cooling stop temperature $T_{CS}$ and before the step of maintaining the head in the temperature range, a step of heating the head of the hot rolled semi-product up to a temperature comprised between 300° C. and 520° C.;

the step of cooling the head of the hot rolled semi-product is performed through water jets;

during the step of cooling the head of the hot rolled semi-product, the entire hot rolled semi-product is cooled such that the temperature of the hot rolled semi-product over time is comprised between the upper boundary and the lower boundary;

during the step of hot rolling the semi-product, the semi-product is hot rolled from a hot rolling starting temperature higher than 1080° C., preferably higher than 1180° C.;

the chemical composition of the steel comprises, the content being expressed by weight percent: 0.30%≤C≤0.60%;

the chemical composition of the steel comprises, the content being expressed by weight percent: 1.25%≤Si≤1.6%; and the chemical composition of the steel comprises, the content being expressed by weight percent: 1.09%≤Mn≤1.5%.

A hot rolled steel part is also provided having a chemical composition comprising, by weight percent:

0.20%≤C≤0.60%, 1.0%≤Si≤2.0%, 0.60%≤Mn≤1.60%, and 0.5≤Cr≤2.2%, and optionally one or more elements chosen among 0.01%≤Mo≤0.3%, 0.01%≤V≤0.30%;

the remainder being Fe and unavoidable impurities resulting from the smelting; the steel rail comprising a head having a microstructure consisting of, in surface fraction:

49% to 67% of bainite,

14% to 25% of retained austenite, the retained austenite having an average carbon content comprised between 0.80% and 1.44%, and 13% to 34% of tempered martensite.

The hot rolled steel part may further comprise one or more of the following features, taken along or according to any technically possible combination:

the surface fraction of bainite in the microstructure of the head of the rail is higher than 56%;

the surface fraction of retained austenite in the microstructure of the head of the rail is comprised between 18% and 23%;

the surface fraction of tempered martensite in the microstructure of the head of the rail is comprised between 14.5% and 22.5%;

the average carbon content in the retained austenite is higher than 1.3%;

the chemical composition of the steel comprises, the content being expressed by weight percent: 0.30%≤C≤0.6%;

the chemical composition of the steel comprises, the content being expressed by weight percent: 1.25%≤Si≤1.6%;

the chemical composition of the steel comprises, the content being expressed by weight percent: 0.9%≤Mn≤1.5%;

the head of the rail has a hardness comprised between 420 HB and 470 HB, preferably higher than 450 HB;

the head of the rail has a tensile strength comprised between 1300 MPa and 1450 MPa;

the head of the rail has a yield strength comprised between 1000 MPa and 1150 MPa; and the head of the rail has a total elongation comprised between 13% and 18%.

BRIEF DESCRIPTION OF THE DRAWINGS

Other aspects and advantages of the invention will appear upon reading the following description, given by way of example and made in reference to the appended drawings, wherein.

DETAILED DESCRIPTION

Figure 1:
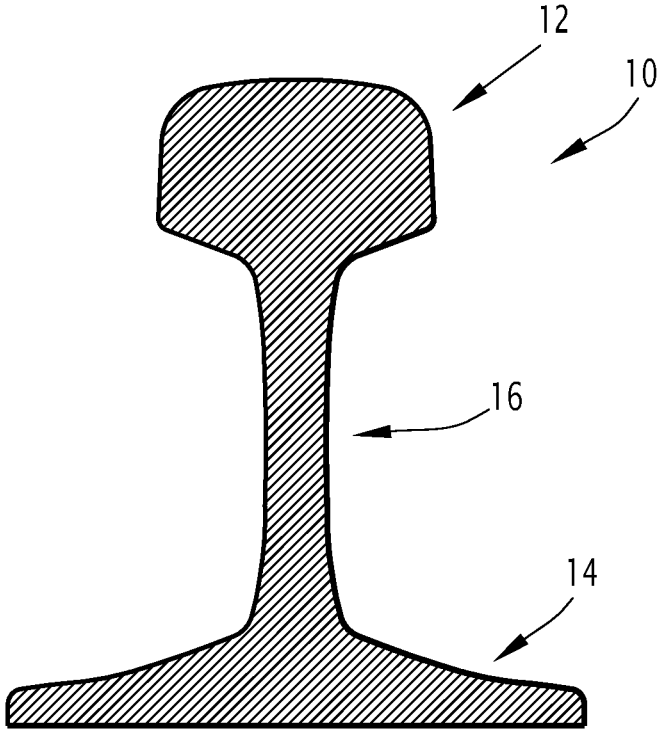
FIG. 1 is a sectional view of the rail.

An embodiment of a rail 10 according to the invention is depicted in FIG. 1.

The rail 10 comprises a head 12 and a foot 14, the foot 14 and the head 12 being connected to each other through a support 16.

As depicted in FIG. 1, the support 16 has a maximal width strictly inferior to the maximal width of the head 12, notably at least inferior to 50% to the maximal width of the head 12.

Likewise, the support has a maximal width strictly inferior to the maximal width of the foot, notably at least inferior to 50% to the maximal width of the foot.

The head 12, the foot 14 and the support 16 are made integral.

The rail 10, in particular the head 12 of the rail 10, is manufactured from a steel having a chemical composition comprising, by weight percent:

0.20%≤C≤0.60%, and more particularly 0.30%≤C≤0.60%, 1.0%≤Si≤2.0%, and preferably 1.25%≤Si≤1.6%.

0.60%≤Mn≤1.60%, and preferably 1.09%≤Mn≤1.5%, and 0.5≤Cr≤2.2%, and optionally one or more elements chosen among 0.01%≤Mo≤0.3%, 0.01%≤V≤0.30%;

the remainder being Fe and unavoidable impurities resulting from the smelting.

In this alloy, carbon is the alloying element having the main effect to control and adjust the desired microstructure and properties of the steel. Carbon stabilizes the austenite and thus leads to its retention even at room temperature. Besides, carbon allows achieving a good mechanical resistance and the desired hardness, combined with a good ductility and impact resistance.

A carbon content below 0.20% by weight leads to the formation of a non-sufficiently stable retained austenite, insufficient hardness and tensile strength, and insufficient rolling-contact fatigue and wear resistances. At carbon contents above 0.60%, the ductility and impact resistance of the steel are deteriorated by the appearance of center-segregation. Therefore, the carbon content is comprised between 0.20% and 0.60% by weight.

The carbon content is preferably comprised between 0.30% and 0.60% by weight percent.

The silicon content is comprised between 1.0% and 2.0% by weight. Si, which is an element which is not soluble in the cementite, prevents or at least delays carbide precipitation, in particular during bainite formation, and allows the diffusion of carbon into the retained austenite, thus favoring the stabilization of the retained austenite. Si further increases the strength of the steel by solid solution hardening. Below 1.0% by weight of silicon, these effects are not sufficiently marked. At a silicon content above 2.0% by weight, the impact resistance might be negatively impacted by the formation of large size oxides. Moreover, an Si content higher than 2.0% by weight might lead to a poor surface quality of the steel.

Preferably, the Si content is comprised between 1.25% and 1.6% by weight.

The manganese content is comprised between 0.60% and 1.60% by weight, and preferably between 1.09% and 1.5%. Mn has an important role to control the microstructure and to stabilize the austenite. As a gammagenic element, Mn lowers the transformation temperature of the austenite, enhances the possibility of carbon enrichment by increasing carbon solubility in austenite and extends the applicable range of cooling rates as it delays perlite formation. Mn further increases the strength of the material by solid solution hardening, and refines the structure. Below 0.6% by weight, these effects are not sufficiently marked. At contents above 1.6%, Mn favors the formation of too large a fraction of martensite, which is detrimental for the ductility of the product.

The chromium content is comprised between 0.5% and 2.2% by weight. Cr is effective in stabilizing the retained austenite, ensuring a predetermined amount thereof. It is also useful for strengthening the steel. However, Cr is mainly added for its hardening effect. Cr promotes the growth of the low-temperature-transformed phases and allows obtaining the targeted microstructure in a large range of cooling rates. At contents below 0.5%, these effects are not sufficiently marked. At contents above 2.2%, Cr favors the formation of too large a fraction of martensite, which is detrimental for the ductility of the product. Moreover, at contents above 2.2%, the Cr addition becomes unnecessarily expensive.

When present, the molybdenum content is comprised between 0.01% and 0.3% by weight. In the steel of the present disclosure, Mo may be present as an impurity, in a content which is generally of at least 0.01%, or added as a voluntary addition. When added, the Mo content is preferably of at least 0.10%. When added, Mo improves the hardenability of the steel and further facilitates the formation of lower bainite by decreasing the temperature at which this structure appears, the lower bainite resulting in a good impact resistance of the steel. At contents greater than 0.3% by weight, Mo can have however a negative effect on this same impact resistance. Moreover, above 0.3%, the Mo addition becomes unnecessarily expensive.

When present, the vanadium content is comprised between 0.01% and 0.30%. Vanadium is optionally added as a strengthening and refining element. When added, the V content is preferably of at least 0.10%. Below 0.10%, no significant effect on the mechanical properties is noted. Above 0.30%, under the manufacturing conditions according to the present disclosure, a saturation of the effect on the mechanical properties is noted. When V is not added, V is generally present as an impurity in a content of at least 0.01%.

The remainder of the composition is iron and unavoidable impurities. In this respect, nickel, phosphorus, sulfur, nitrogen, oxygen and hydrogen are considered as residual elements which are unavoidable impurities. Therefore, their contents are at most 0.05% Ni, at most 0.025% P, at most 0.020% S, at most 0.009% N, at most 0.003% 0 and at most 0.0003% H.

The rail 10, in particular the head 12 of the rail 10, has a microstructure consisting of, in surface fractions:

49% to 67% of bainite,

14% to 25% of retained austenite, and

13% to 34% of tempered martensite.

The bainite can include granular bainite and lath-like carbide free bainite. In the frame of the present disclosure, carbide free bainite will designate bainite containing less than 100 carbides per surface unit of 100 square micrometer.

Preferably, the surface fraction of bainite in the microstructure of the head 12 is higher than or equal to 56%.

The retained austenite and the tempered martensite are generally present as M/A constituents, located between the laths or plates of bainite.

The austenite is also contained in the bainite between the laths or plates of bainite.

The retained austenite has an average carbon content comprised between 0.83% and 1.44%, preferably higher than 1.3%.

Preferably, the surface fraction of retained austenite in the microstructure of the head 12 is comprised between 18% and 23%.

The tempered martensite is contained in the bainite between the laths or plates of bainite, and in the M/A components.

The martensite is tempered martensite and preferably self-tempered martensite. Generally, the tempered martensite has a low carbon content, i.e. an average C content strictly lower than the average C content in the steel.

Preferably, the surface fraction of tempered martensite in the microstructure of the head 12 is comprised between 14.5% and 22.5%.

The head 12 of the rail 10 has a hardness of at least 420 HB, generally comprised between 430 HB and 470 HB, a tensile strength of at least 1300 MPa, generally comprised between 1300 MPa and 1450 MPa, a yield strength of at least 1000 MPa, generally comprised between 1000 MPa and 1150 MPa, and a total elongation of at least 13%, generally comprised between 13% and 18%.

The manufacturing of the rail 10 according to the present disclosure can be done by any suitable method.

A preferred method to produce such rail comprises a step of casting a steel so as to obtain a semi-product, said steel having the above chemical composition.

The method further comprises a step of hot rolling the semi-product into a hot rolled semi-product having the shape of the rail 10 and comprising a head 12, with a final rolling temperature $T_{FRT}$ higher than Ar3.

Preferably, during the step of hot rolling the semi-product, the semi-product is hot rolled from a hot rolling starting temperature higher than 1080° C., preferably higher than 1180° C.

For example, before hot-rolling, the semi-product is reheated to a temperature comprised between 1150° C. and 1270° C. and then hot rolled.

After finishing hot rolling, the rail 10 is passed preferably throughout an induction furnace. This allows avoiding austenite decomposition.

Figure 2:
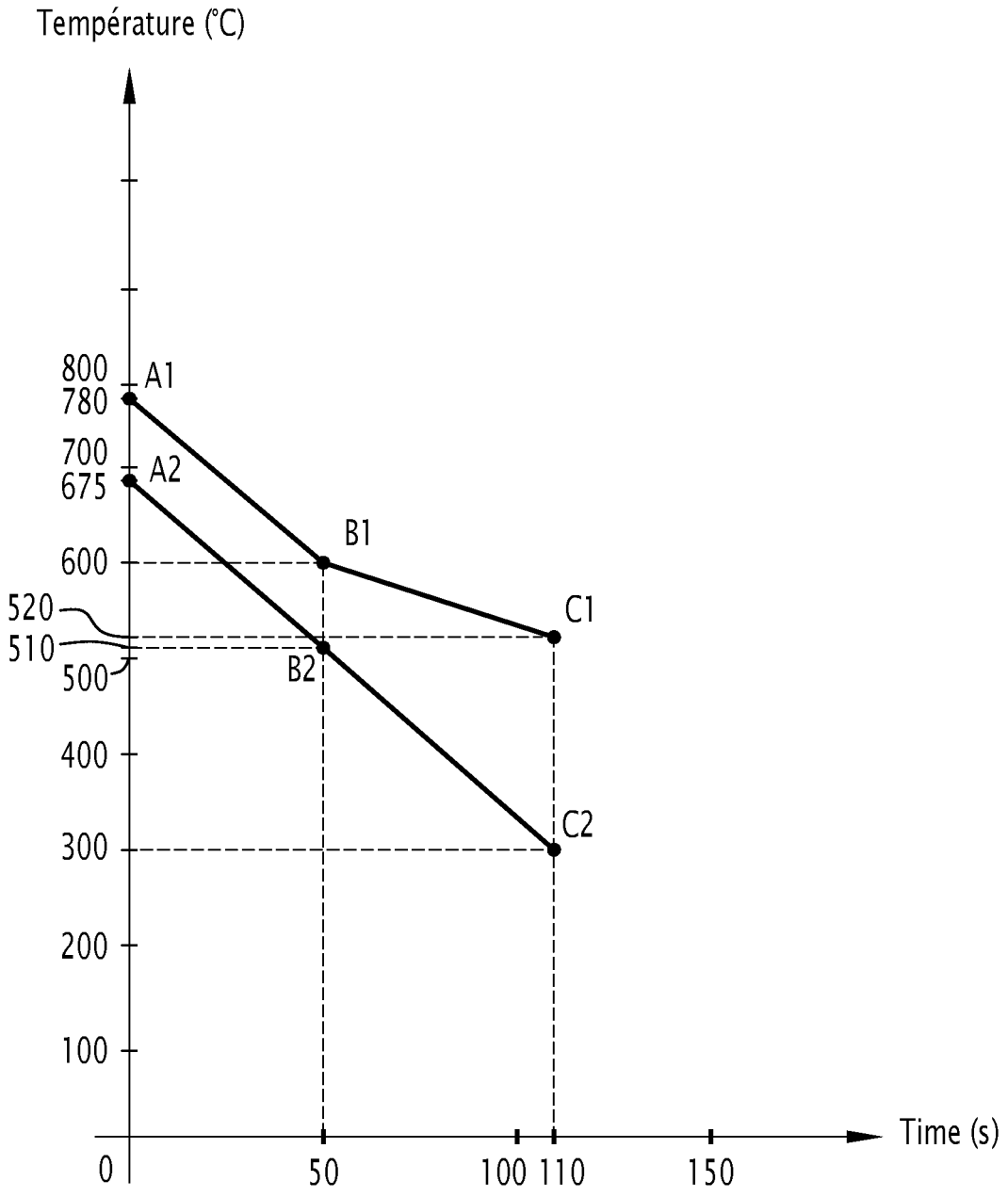
FIG. 2 is a graph showing the upper boundary and the lower boundary of the temperature over time during the step of cooling the head.

The method for manufacturing a rail 10 comprises then the cooling of the head 12 of the hot rolled semi-product from the final rolling temperature $T_{FRT}$ down to a cooling stop temperature $T_{CS}$ comprised between 200° C. and 520° C., such that the temperature of the head 12 of the hot rolled semi-product over time is comprised between a upper boundary and a lower boundary, depicted on FIG. 2, the upper boundary having the coordinates of time and temperature defined by A1 (0 second, 780° C.), B1 (50 seconds, 600° C.), and C1 (110 seconds, 520° C.), the lower boundary having the coordinates of time and temperature defined by A2 (0 second, 675° C.), B2 (50 seconds, 510° C.), and C2 (110 seconds, 300° C.).

The cooling stop temperature $T_{CS}$ is the temperature at which the cooling is stopped.

In a first embodiment, the cooling stop temperature $T_{CS}$ is comprised between 300° C. and 520° C.

In this embodiment, the head may reach the cooling stop temperature $T_{CS}$ before or after reaching a point comprised between the points C1 and C2 defined above.

In a second embodiment, the cooling stop temperature $T_{CS}$ is comprised between 200° C. and 300° C. In this embodiment, during the cooling, after reaching a point comprised between the points C1 and C2, the head 12 is further cooled to the cooling stop temperature $T_{CS}$. During the cooling to the cooling stop temperature $T_{CS}$, a partial transformation of the austenite to bainite and martensite occurs.

If the head 12 of the hot rolled semi-product is cooled such that its temperature over time is higher than the upper boundary, ferrite and pearlite will form and carbides will precipitate upon cooling, so that the desired structure will not be obtained.

If the head 12 of the hot rolled semi-product is cooled such that its temperature over time is lower than the lower boundary, a too high martensite fraction and an insufficient fraction of bainite will be obtained.

More specifically, during this step of cooling the head 12 of the hot rolled semi-product, the entire hot rolled semi-product is cooled such that the temperature of the hot rolled semi-product over time is comprised between the upper boundary and the lower boundary.

The step of cooling the head 12 of the hot rolled semi-product is preferably performed through water jets. Such water jets allow achieving fast cooling rates and controlled heat release and recovery temperatures.

After this step of cooling, the method comprises a step of maintaining the head 12 of the hot rolled semi-product in a temperature range comprised between 300° C. and 520° C. during a holding time $t_{hold}$ of at least 12 minutes, the holding time $t_{hold}$ being advantageously comprised between 15 min and 23 min.

Preferably, the entire hot rolled semi-product is maintained in a temperature range comprised between 300° C. and 520° C. during said holding time $t_{hold}$.

During this step of maintaining, the transformation of the austenite to bainite is completed.

Besides, carbon partitions from the martensite to the austenite, thus stabilizing austenite and tempering the martensite.

If the holding time $t_{hold}$ in the temperature range comprised between 300° C. and 520° C. is lower than 12 minutes, an insufficient fraction of bainite is formed, so that a too important transformation of the austenite into martensite will occur during the subsequent cooling to room temperature.

For example, the head 12 is held at a holding temperature $T_{hold}$ comprised between 300° C. and 520° C.

If the cooling stop temperature is comprised between 300° C. and 520° C., the step of maintaining the head 12 in the temperature range comprised between 300° C. and 520° C. for the holding time $t_{hold}$ is for example performed immediately after the cooling to the cooling stop temperature $T_{CS}$. In addition, the holding temperature $T_{hold}$ is higher than or equal to the cooling stop temperature $T_{CS}$.

If the cooling stop temperature is comprised between 200° C. and 300° C., the method further comprises, after the cooling of the head to the cooling stop temperature $T_{CS}$ and before the step of maintaining the head in the temperature range, a step of heating the head of the hot rolled semi-product up to a temperature comprised between 300° C. and 520° C. In such case, the holding temperature $T_{hold}$ is higher than the cooling stop temperature $T_{CS}$.

After the maintaining of the head 12 in the temperature range comprised between 300° C. and 520° C., the hot rolled semi-product is cooled down to room temperature to obtain the rail 10. The hot rolled semi-product is cooled down to room temperature, preferably through air cooling, and in particular through natural air cooling.

Advantageously, after cooling, the rail 10 has a microstructure consisting of, in surface fractions:

49% to 67% of bainite,

14% to 25% of retained austenite, and

13% to 34% of tempered martensite.

The bainite can include granular bainite and carbide free bainite. Preferably, the surface fraction of bainite in the microstructure of the head 12 is higher than or equal to 56%.

The retained austenite and the tempered martensite are generally present as M/A constituents, located between the laths or plates of bainite.

The austenite is also contained in the bainite between the laths or plates of bainite.

The retained austenite has an average carbon content comprised between 0.80% and 1.44%, preferably higher than 1.3%.

Preferably, the surface fraction of retained austenite in the microstructure of the head 12 is comprised between 18% and 23%.

The tempered martensite is contained in the bainite between the laths or plates of bainite, and in the M/A components.

The martensite is tempered martensite and preferably self-tempered martensite. Generally, the martensite has a low carbon content, i.e. an average C content strictly lower than the average C content in the steel.

Preferably, the surface fraction of tempered martensite in the microstructure of the head 12 is comprised between 14.5% and 22.5%.

The head 12 of the rail 10 has a hardness comprised between 430 HB and 470 HB, a tensile strength comprised between 1300 MPa and 1450 MPa, a yield strength comprised between 1000 MPa and 1150 MPa, and a total elongation comprised between 13% and 18%.

Optionally, the method may further comprise finishing steps, and in particular machining or surface treatment steps, performed for example after cooling down the hot rolled semi-product to room temperature. The surface treatment steps may in particular be a shot peening treatment.

EXAMPLES

The inventors of the present invention have carried out the following experiments.

Steels with composition according to Table 1, expressed by weight, were provided under the form of semi-product.

TABLE 1

| Steel | C (%) | Si (%) | Mn (%) | P (%) | S (%) | Cr (%) | Mo (%) | N (ppm) | O (ppm) | H (ppm) |
|---|---|---|---|---|---|---|---|---|---|---|
| 523513-L* | 0.300 | 1.50 | 1.10 | 0.017 | 0.009 | 1.99 | 0.12 | 50 | — | 1.5 |
| 523514-L | 0.318 | 1.52 | 1.11 | 0.017 | 0.011 | 1.97 | 0.02 | 56 | — | 1.6 |

The semi-products were hot-rolled into hot rolled semi-products having the shape of the rail, with a final rolling temperature $T_{FRT}$ higher than Ar3, then cooled from the final rolling temperature $T_{FRT}$ down to a cooling stop temperature $T_{CS}$, with a cooling rate such that, from a temperature T0 at an initial cooling time t0=0 s, the hot rolled semi-products reached a temperature $T_{50}$ after 50 s of cooling, and then a temperature $T_{110}$ after 110 s of cooling.

The heads of the rails were then maintained in a temperature range comprised between 300° C. and 520° C., at a temperature $T_{hold}$ equal to the cooling stop temperature $T_{CS}$ during a holding time $t_{hold}$.

The rails were finally cooled down to the room temperature.

The manufacturing conditions of the rails are summarized in Table 2 below.

TABLE 2

| Steel | | $T_{FRT}$ (° C.) | T0 (° C.) | $T_{50}$ (° C.) | Average cooling rate between T0 and T1 (° C./s) | $T_{110}$ (° C.) | Average cooling rate between T1 and $T_{CS}$ (° C./s) | $T_{CS}$ (° C.) | $t_{hold}$ (min) |
|---|---|---|---|---|---|---|---|---|---|
| 523513-Y208 | 523513-L* | 998 | 750 | 592 | 3.2 | 481 | 1.9 | 434 | 18 |
| 523513-Y308 | 523513-L* | 1012 | 754 | 572 | 3.6 | 446 | 2.1 | 429 | 20 |
| 523514-A208 | 523514-L | 1003 | 751 | 563 | 3.8 | 467 | 1.6 | 423 | 23 |

Chemical Composition:

Samples for chemical analysis were obtained from tensile test sample location as stated in 9.1.3 in of EN 13674-1:2011, and then polished and analysed by spark emission spectroscopy to determine the average weight percentage (wt %). In addition, several pins of 1 g were extracted, degreased and subjected to a combustion trace elemental analysis to find out the percentage of N, O, S and C in a LECO C/S & LECO N/O analyzer. Hydrogen was also analyzed by IR-absorption. The chemical composition of the steels is shown below in Table 3.

TABLE 3

| | wt. % | | | | | | | ppm | | |
|---|---|---|---|---|---|---|---|---|---|---|
| Sample | C | Si | Mn | P | S | Cr | Mo | N | O | H |
| 523513-Y208 | 0.34 | 1.59 | 1.09 | 0.020 | 0.014 | 2.07 | 0.05 | 65.8 | 29.1 | 1.8 |
| 523514-A208 | 0.34 | 1.58 | 1.09 | 0.019 | 0.016 | 2.04 | 0.01 | 63.9 | 10.6 | 1.5 |
| 523513-Y308 | 0.3 | 1.59 | 1.1 | 0.017 | 0.011 | 2.05 | 0.06 | NA | NA | NA |

Fatigue Test:

Fatigue samples were extracted from the head of the rail and machined according to ASTM E606-12.

The fatigue tests were performed at room temperature in a hydraulic universal testing machine INSTRON 8801, in strain control with "peak to peak" amplitude of 0.00135 The waveform used was a sine wave, with a symmetrical strain of +0.000675 μm in tension and a strain of −0.000675 μm in compression. The run-out was 5 million cycles, stopping the test at this value.

Three replicates were tested on each sample.

The run-out was 5 million cycles, stopping the test at that value.

TABLE 4

| Sample | Reps | Cycles (Test stopped at |
|---|---|---|
| 523513Y208 | 1 | Run out ($5 \cdot 10^6$ cycles) |
| | 2 | |
| | 3 | |

TABLE 4-continued

| Sample | Reps | Cycles (Test stopped at |
|---|---|---|
| 523514A208 | 1 | Run out ($5 \cdot 10^6$ cycles) |
| | 2 | |
| | 3 | |
| 523513Y308 | 1 | Run out ($5 \cdot 10^6$ cycles) |
| | 2 | |
| | 3 | |

Microstructure—Optical microscopy:

Metallographic samples were obtained from rail head according with Clause 9.1.4 in EN 13674-1:2011.

The metallographic samples were grinded, polished and etched with Nital 2% to reveal the microstructure of the rail samples. Microscopic observation was carried out using a Leica DMi4000 microscope.

The overall microstructure appearance in the whole rail head is fully bainitic, i.e. consists of laths or plates of bainite, and martensite and austenite dispersed between the laths or plates of bainite, for all the samples. The nature of the microstructure was analyzed in more detail by high resolution scanning electron microscopy and XR-Diffraction.

Characterization of the Microstructure by XR-Diffraction and High Resolution Scanning Electron Microscopy:

A detailed analysis was performed on the sample 523513Y208. Electron microscopy analysis was done by means of a high resolution field-emission gun electron microscope (FEG-SEM) Zeiss Ultra Plus. Diffraction tests were performed on X-ray diffractometer Bruker D8 Advance using CuKα radiation.

Austenite content and its carbon content were measured by XRD following the recommendations of ASTM E975 standard.

The content of the M/A constituent was obtained by manual points count method on SEM images according to ASTM E562 standard. The martensite content is then determined by subtracting from the content of M/A constituent the content of retained austenite measured by XRD. The balance to 100% consists of bainite.

The microstructure comprises 61.3% of bainite, 20.20% of retained austenite with a carbon content of 1.38% and 18.5% of martensite.

Hardness:

On the one hand, Brinell hardness was evaluated at the rail head rolling surface in compliance with Clause 9.1.8 in EN 13674-1:2011 (mean value out of three measurements).

On the other hand, Brinell hardness was evaluated on cross-section of the rail and using an automatic durometer Leco LV700AT.

Table 5 shows averages values of hardness test in rolling surface (RS) and on different points of the cross section.

TABLE 5

| | | Point 1 | | | Point 2 | | Point 3 | Point 4 | |
|---|---|---|---|---|---|---|---|---|---|
| Sample | RS | Left | Centre | Right | Left | Right | Centre | Left | Right |
| 523513/208 | 430 | 417 | 438 | 426 | 429 | 432 | 420 | 412 | 420 |
| 523514/208 | 431 | 429 | 432 | 420 | 426 | 420 | 426 | 426 | 420 |
| 523513/308 | 434 | 461 | 443 | 441 | 440 | 442 | 435 | 433 | 461 |

Tensile Test:

According to Clause 9.1.9 in EN 13674-1:2011 tensile test was carried out in accordance to ISO 6892-1 using proportional circular test pieces of 10 mm diameter. Test samples ($D_0$=10 mm, $L_0$=50 mm) were extracted and tested using an Instron 600DX universal mechanical testing machine.

Three replicates were tested for each sample.

Table 6 shows the results for yield strength (YS), tensile strength (TS) and elongation ($A_{50}$).

TABLE 6

| Sample | YS (MPa) | TS (MPa) | $A_{50}$ (%) |
|---|---|---|---|
| 523513/Y208 | 1089 | 1440 | 14 |
| 523514/A208 | 1098 | 1452 | 14 |
| 523514/Y308 | 1052 | 1442 | 14 |

Linear Thermal Expansion Coefficient (LTEC):

LTEC was measured in the rolling direction of the rail. Test samples (4 mm diameter and 10 mm length) were extracted from the tensile sample centre location and coefficient of thermal expansion was evaluated from −70° C. to 70° C. at 2° C./min by high resolution dilatometry (BAHR 805A/D).

Figure 3:
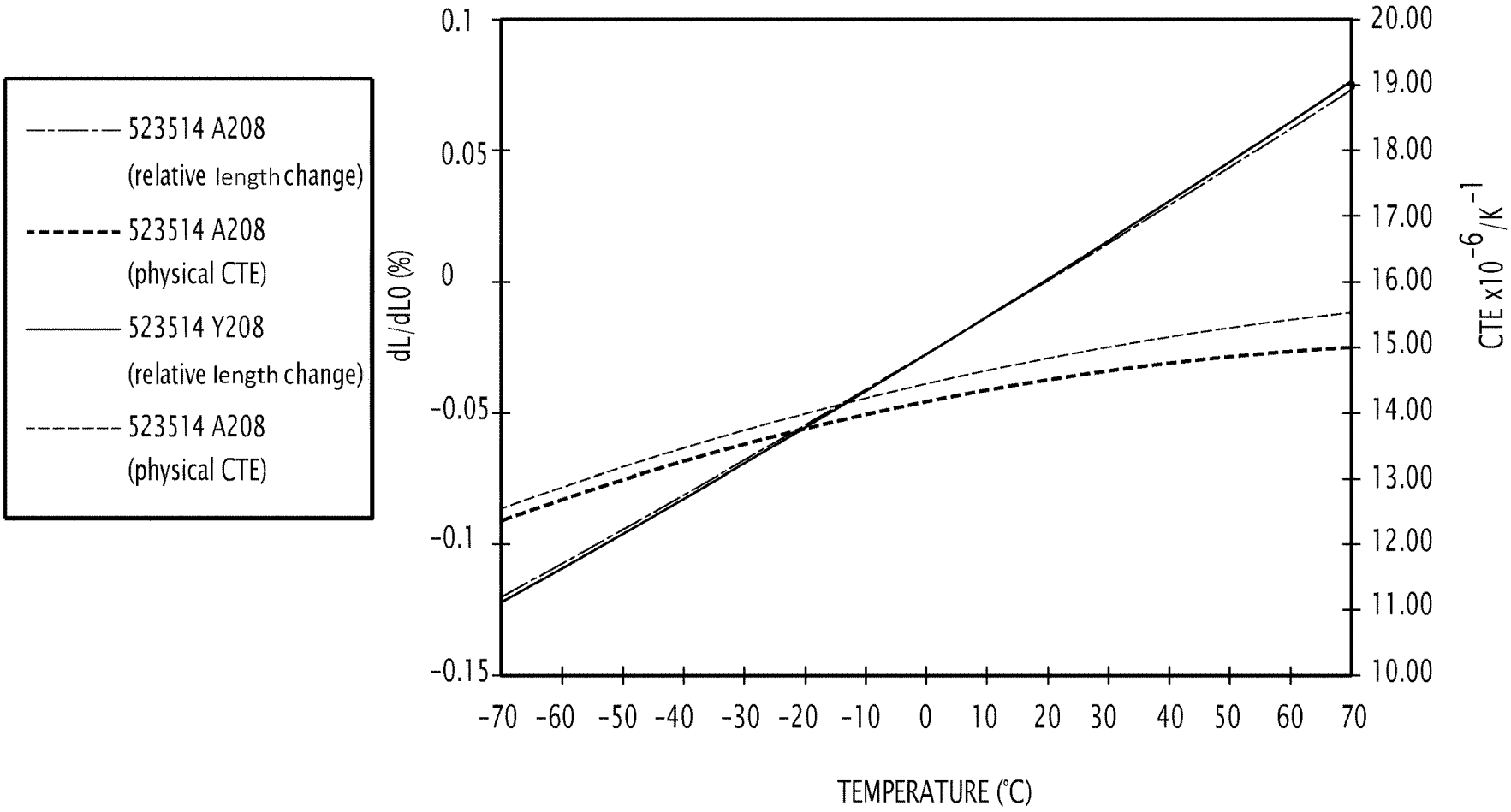
FIG. 3 is a graph of the linear thermal expansion coefficients of three samples coefficient of thermal expansion function of the temperature.

Relative length change ($dL/L_0$) and the coefficient of thermal expansion (CTE) for one of the three heating runs performed are depicted in FIG. 3.

Next, the technical LTEC, using 25° C. as reference temperature, is shown in Table 7.

TABLE 7

| Grade/Heat/Rail | $LTEC_{25/50}$ | $LTEC_{25/0}$ | $LTEC_{25/-25}$ | $LTEC_{25/-50}$ |
|---|---|---|---|---|
| BAM 60E2/523513/Y208 | 15.1 | 14.5 | 11.3 | 12.0 |
| BAM 60E2/523514/A208 | 14.6 | 14.4 | 11.2 | 11.9 |

The invention claimed is:

1. A steel rail, made of a steel having a chemical composition comprising, by weight percent:

0.20%≤C≤0.60%, 1.0%≤Si≤2.0%, 0.60%≤Mn<1.5%, and 0.5%≤Cr≤2.2%, and optionally one or more elements chosen among 0.01%≤Mo≤0.3%, 0.01%≤V≤0.30%;

a remainder being Fe and unavoidable impurities resulting from smelting;

the steel rail comprising a head having a microstructure consisting of, in area fraction:

49% to 67% of bainite,

14% to 25% of retained austenite, the retained austenite having an average carbon content comprised between 1.3% and 1.44%, 13% to 34% of tempered martensite, wherein the head of the rail has a tensile strength comprised between 1300 MPa and 1452 MPa, a yield strength of at least 1000 MPa, a total elongation of at least 13%, and a hardness in a rolling surface of the head of at least 420 HB.

2. The steel rail according to claim 1, wherein the area fraction of bainite in the microstructure of the head of the rail consists of between 56% and 67%.

3. The steel rail according to claim 1, wherein the area fraction of retained austenite in the microstructure of the head of the rail consists of between 18% and 23%.

4. The steel rail according to claim 1, wherein the area fraction of tempered martensite in the microstructure of the head of the rail consists of between 14.5% and 22.5%.

5. The steel rail according to claim 1, wherein the chemical composition of the steel comprises, by weight percent, 0.30%≤C≤0.6%.

6. The steel rail according to claim 1, wherein the chemical composition of the steel comprises, by weight percent, 1.25%≤Si≤1.6%.

7. The steel rail according to claim 1, wherein the chemical composition of the steel comprises, by weight percent, 0.9%≤Mn<1.5%.

8. The steel rail according to claim 1, wherein the head of the rail has a hardness in the rolling surface of the head comprised between 420 HB and 470 HB.

9. The steel rail according to claim 8, wherein the head of the rail has a hardness in the rolling surface of the head comprised between 450 HB and 470 HB.

10. The steel rail according to claim 1, wherein the head of the rail has a tensile strength comprised between 1300 MPa and 1450 MPa.

11. The steel rail according to claim 1, wherein the head of the rail has a yield strength comprised between 1000 MPa and 1150 MPa.

12. The steel rail according to claim 1, wherein the head of the rail has a total elongation comprised between 13% and 18%.

13. The steel rail according to claim 1, wherein the chemical composition of the steel comprises, by weight percent, 1.97%≤Cr≤2.2%.

14. A steel rail, made of a steel having a chemical composition comprising, by weight percent:

0.20%≤C≤0.60%,
1.0%≤Si≤2.0%,
0.60%≤Mn≤1.60%,
and 1.97%≤Cr≤2.2%,
and optionally one or more elements chosen among
0.01%≤Mo≤0.3%,
0.01%≤V≤0.30%;
a remainder being Fe and unavoidable impurities resulting from smelting;

the steel rail comprising a head having a microstructure consisting of, in area fraction:

49% to 67% of bainite,
14% to 25% of retained austenite, the retained austenite having an average carbon content comprised between 1.3% and 1.44%,
13% to 34% of tempered martensite,
wherein the head of the rail has a tensile strength comprised between 1300 MPa and 1452 MPa, a yield strength of at least 1000 MPa, a total elongation of at least 13%, and a hardness in a rolling surface of the head of at least 420 HB.

15. The steel rail according to claim 14, wherein the chemical composition of the steel comprises, by weight percent, 0.9%≤Mn≤1.5%.

16. The steel rail according to claim 14, wherein the area fraction of bainite in the microstructure of the head of the rail consists of between 56% and 67%.

17. The steel rail according to claim 14, wherein the area fraction of retained austenite in the microstructure of the head of the rail consists of between 18% and 23%.

18. The steel rail according to claim 14, wherein the area fraction of tempered martensite in the microstructure of the head of the rail consists of between 14.5% and 22.5%.

19. An uncoated steel rail, made of a steel having a chemical composition comprising, by weight percent:

0.20%≤C≤0.60%,
1.0%≤Si≤2.0%,
either 0.60%≤Mn<1.5% and 0.5%≤Cr≤2.2%,
or 0.60%≤Mn≤1.60% and 1.97%≤Cr≤2.2%,
and optionally one or more elements chosen among
0.01%≤Mo≤0.3%,
0.01%≤V≤0.30%;
a remainder being Fe and unavoidable impurities resulting from smelting;

the steel rail comprising a head having a microstructure consisting of, in area fraction:

49% to 67% of bainite,
14% to 25% of retained austenite, the retained austenite having an average carbon content comprised between 1.3% and 1.44%,
13% to 34% of tempered martensite,
wherein the head of the rail has a tensile strength of at least 1300 MPa, a yield strength of at least 1000 MPa, a total elongation of at least 13%, and a hardness in a rolling surface of the head of at least 420 HB.

* * * * *